US008360133B2

(12) United States Patent
Kawamura et al.

(10) Patent No.: US 8,360,133 B2
(45) Date of Patent: Jan. 29, 2013

(54) MOLD BORING METHOD, MOLD BORING TOOL AND MOLD BORING APPARATUS

(75) Inventors: Naoya Kawamura, Shizuoka-Ken (JP); Hiroyuki Gokaku, Shizuoka-Ken (JP); Noriyuki Mitsui, Shizuoka-Ken (JP); Masao Iwamoto, Shizuoka-Ken (JP); Hidekazu Asano, Shizuoka-Ken (JP); Satomi Imura, Shizuoka-Ken (JP)

(73) Assignee: Suzuki Motor Corporation, Shizuoka-ken (JP)

( * ) Notice: Subject to any disclaimer, the term of this patent is extended or adjusted under 35 U.S.C. 154(b) by 0 days.

(21) Appl. No.: 13/305,259

(22) Filed: Nov. 28, 2011

(65) Prior Publication Data

US 2012/0132386 A1 May 31, 2012

(30) Foreign Application Priority Data

Nov. 29, 2010 (JP) ..... 2010-265670

(51) Int. Cl.
*B22C 9/02* (2006.01)
*B22C 19/00* (2006.01)

(52) U.S. Cl. ..... 164/17; 164/161

(58) Field of Classification Search ..... 164/6, 17, 164/159, 234, 410, 161
See application file for complete search history.

(56) References Cited

U.S. PATENT DOCUMENTS 4,195,682 A * 4/1980 Muller ..... 164/6
2009/0101300 A1* 4/2009 Hirz et al. ..... 164/15

FOREIGN PATENT DOCUMENTS

JP 11010284 1/1999

* cited by examiner

*Primary Examiner* — Kevin P Kerns
(74) *Attorney, Agent, or Firm* — Barnes & Thornburg LLP

(57) ABSTRACT

A mold boring apparatus including a mold boring tool having a flow passage formed inside of the mold boring tool which allows a fluid to flow therethrough, having slits and protruding portions formed on an outer peripheral portion of an outer body of a tool blade member of the mold boring tool in a circumferential direction thereof extending from a leading end to a base end of the tool blade member, and blades that are inclined inward and are formed at leading ends of the protruding portions formed between the adjacent slits.

2 Claims, 13 Drawing Sheets

SPECIFICATION A

SPECIFICATION B

SPECIFICATION C

| TOOL BLADE MEMBER | BORING TOOL SHAPE | | |
|---|---|---|---|
| | SPECIFICATION A (TWISTING ANGLE 5.5° ) | SPECIFICATION B (TWISTING ANGLE 13.4° ) | SPECIFICATION C (TWISTING ANGLE 0° ) |
| OUTER DIAMETER (mm) | 10 | 10 | 10 |
| AXIAL LENGTH (mm) | 15 | 15 | 15 |
| TWISTED ANGLE (° ) | 5.5 | 13.4 | 0 |
| CUTOUT NUMBER | 6 | 6 | 6 |
| CUTOUT WIDTH (mm) | 3 | 3 | 3 |
| AIR BLASTING AREA ($mm^2$) | 12.57 | 12.57 | 12.57 |
| DISCHARGED SAND AREA ($mm^2$) | 16.62 | 16.62 | 16.62 |

FIG. 5

| | BORING TIME (SECOND) | | |
|---|---|---|---|
| EXAMPLE (No.) | SPECIFICATION A (TWISTING ANGLE 5.5° ) | SPECIFICATION B (TWISTING ANGLE 13.4° ) | SPECIFICATION C (TWISTING ANGLE 0° ) |
| 1 | 5.33 | 5.78 | 8.73 |
| 2 | 3.34 | 3.50 | 5.57 |
| 3 | 3.42 | 4.10 | 4.13 |
| 4 | 4.34 | 6.42 | 6.20 |
| 5 | 2.97 | 7.14 | 3.03 |
| 6 | 4.27 | 5.20 | 7.14 |
| 7 | 3.17 | 2.84 | 4.93 |
| 8 | 3.39 | 3.43 | 3.43 |
| 9 | 5.02 | 5.78 | 9.41 |
| 10 | 3.44 | 3.50 | 2.64 |
| 11 | 4.14 | 4.10 | 9.38 |
| 12 | 4.22 | 6.42 | 9.90 |
| 13 | 3.21 | 7.14 | 4.84 |
| 14 | 3.12 | 5.20 | 4.48 |
| 15 | 4.55 | 2.84 | 4.74 |
| 16 | 4.80 | 3.43 | 8.19 |
| 17 | 6.00 | 4.48 | 3.49 |
| 18 | 5.20 | 5.57 | 6.28 |
| 19 | 5.80 | 4.05 | 3.79 |
| 20 | 4.60 | 3.50 | 5.24 |
| 21 | 3.80 | 4.10 | 10.98 |
| 22 | 3.50 | 5.78 | 7.53 |
| 23 | 4.76 | 3.50 | 6.34 |
| 24 | 4.70 | 4.10 | 4.33 |
| 25 | 5.60 | 6.42 | 3.44 |
| 26 | 4.50 | 7.14 | 9.90 |
| 27 | 3.70 | 5.20 | 4.84 |
| 28 | 3.00 | 2.84 | 4.48 |
| 29 | 4.50 | 3.43 | 9.90 |
| 30 | 3.70 | 4.48 | 9.84 |
| 31 | 3.40 | 5.57 | 4.48 |
| 32 | 4.20 | 4.35 | 4.74 |
| AVERAGETIME | 4.2 | 4.7 | 6.1 |
| STANDARD DEVIATION | 0.9 | 1.3 | 2.5 |

FIG. 7

| | HOLE DIAMETER (mm) | | |
|---|---|---|---|
| EXAMPLE (No.) | SPECIFICATION A (TWISTING ANGLE 5.5° ) | SPECIFICATION B (TWISTING ANGLE 13.4° ) | SPECIFICATION C (TWISTING ANGLE 0° ) |
| 1 | 10.6 | 12.3 | 14.5 |
| 2 | 10.3 | 12.5 | 13.7 |
| 3 | 10.3 | 11.2 | 13.0 |
| 4 | 10.6 | 10.8 | 12.5 |
| 5 | 10.6 | 10.8 | 16.2 |
| 6 | 10.5 | 10.8 | 12.5 |
| 7 | 10.5 | 10.4 | 12.5 |
| 8 | 10.6 | 10.6 | 12.5 |
| 9 | 10.6 | 11.3 | 10.8 |
| 10 | 10.2 | 10.6 | 13.5 |
| 11 | 10.5 | 11.0 | 10.6 |
| 12 | 10.5 | 10.8 | 12.5 |
| 13 | 10.5 | 10.8 | 12.5 |
| 14 | 10.5 | 10.4 | 14.4 |
| 15 | 10.5 | 10.6 | 12.5 |
| 16 | 10.7 | 10.8 | 12.5 |
| 17 | 10.5 | 10.6 | 10.8 |
| 18 | 10.5 | 10.6 | 10.4 |
| 19 | 10.3 | 10.8 | 10.6 |
| 20 | 10.3 | 10.8 | 12.5 |
| 21 | 10.5 | 10.5 | 10.3 |
| 22 | 10.5 | 10.5 | 12.5 |
| 23 | 10.5 | 10.3 | 12.5 |
| 24 | 10.4 | 11.0 | 10.8 |
| 25 | 10.4 | 10.5 | 12.1 |
| 26 | 10.6 | 10.8 | 14.0 |
| 27 | 10.6 | 10.5 | 13.3 |
| 28 | 10.6 | 10.4 | 10.8 |
| 29 | 10.6 | 10.8 | 12.5 |
| 30 | 10.6 | 11.2 | 13.5 |
| 31 | 10.6 | 11.3 | 15.2 |
| 32 | 10.7 | 10.8 | 12.5 |
| MEAN DIAMETER | 10.50625 | 10.846875 | 12.53125 |
| STANDARD DEVIATION | 0.121648621 | 0.483925064 | 1.429287551 |

FIG. 8

BORING TIME

HOLE DIAMETER

| | | BORING TIME | | HOLE DIAMETER | |
|---|---|---|---|---|---|
| | | AVERAGETIME (SECOND) | STANDARD DEVIATION | MEAN DIAMETER (mm) | STANDARD DEVIATION |
| BORING TOOL SHAPE | SPECIFICATION A (TWISTING ANGLE 5.5° ) | 4.2 | 0.9 | 10.5 | 0.1 |
| | SPECIFICATION B (TWISTING ANGLE 13.4° ) | 4.7 | 1.3 | 10.8 | 0.5 |
| | SPECIFICATION C (TWISTING ANGLE 0° ) | 6.1 | 2.5 | 12.5 | 1.4 |

FIG. 11

MOLD BORING METHOD, MOLD BORING TOOL AND MOLD BORING APPARATUS

PRIORITY CLAIM

This patent application claims priority to Japanese Patent Application No. 2010-265670, filed Nov. 29, 2010, the disclosure of which is incorporated herein by reference in its entirety.

BACKGROUND

1. Field

Disclosed embodiments relate to a mold boring method, a mold boring tool, and a mold boring apparatus for making a hole in a mold such as a degassing hole in a mold, particularly, a sand mold.

2. Related Art

There is conventionally known a method of making a hole such as degassing hole in a mold, i.e., sand mold, by forming a punching hole by moving a punching pin (degassing pin or needle) by using a cylinder assembly, for example, as disclosed in Japanese Patent Laid-Open Publication No. 11-10284 (Patent Document 1) or a method of making a hole by rotating a drill.

FIG. 6B shows one example representing the punching method by using the punching (boring) pin to form the degassing hole in the mold. In this method, when a punching pin 101 is inserted into sand 103 of a mold 102 as illustrated in FIG. 6B, an excessive compressive force P acts on the sand 103 in the mold 102 because the volume of the mold 102 does not change. Consequently, when the punching pin 101 passes through the mold 102, the compressive force P concentrates on a punching (boring) penetration boundary side 104 of the mold 102, which may result in breaking of the mold 102 at the penetration boundary side 104, and broken sand 105 may drop off. Accordingly, if punched (bored) holes are formed at points adjacent to each other, the holes may be continuously connected to each other, and thus, will not attain function as holes. In addition, if a hole is formed near a sprue (pouring gate), there is a possibility of breaking or collapsing the sprue.

Furthermore, if an action of the punching pin 101 applies an excessive compressive force P to the sand 103 of the mold 102, a reaction force thereof may make the punching pin 101 more deformable, and in such case, it becomes difficult to form a hole having a small diameter.

On the other hand, according to the cutting method by using the drill to form the degassing hole in the mold, a large load is applied to the drill, which may break the drill, so that it becomes difficult to form a hole having a small diameter with high precision. Moreover, a rotating mechanism for rotating the drill is required, which will result in an increase of size of entire unit or apparatus.

SUMMARY

The disclosed embodiments provide a mold boring method, a mold boring tool and a mold boring apparatus for making a hole in a mold, especially, sand mold at a small load while suppressing possibility of the breakage of the mold.

One disclosed embodiment provides a method of boring a hole in a mold, comprising:

preparing a mold boring apparatus including a mold boring tool having a flow passage that is formed inside of the mold boring tool and allows a fluid to flow therethrough, a plurality of slits and a plurality of protruding portions that are formed on an outer peripheral portion of an outer body of a tool blade member of the mold boring tool in a circumferential direction thereof so as to extend from a leading end to a base end of the tool blade member, and a plurality of blades that are inclined inward and are respectively formed at leading ends of the protruding portions formed between the adjacent slits;

fitting the tool blade member to a leading end of a support pipe provided for a mount plate of the mold boring apparatus so as to support the tool blade member;

introducing the fluid from the support pipe into the flow passage of the tool blade member of the mold boring tool when the mold boring tool is moved in an axial direction thereof to be stuck into sand of the mold; and boring the hole in the mold while the blades of the mold boring tool act to collapse the sand of the mold to an inner side of the tool blade member of the boring tool, and the sand collapsed by the blades is discharged to an outside of the mold through the slits by an action of the fluid flowing from the flow passage into the slits.

Another disclosed embodiment provides a mold boring tool, comprising:

a mount plate that is connected to a body of a mold boring apparatus;

a plurality of support pipes provided for the mount plate so as to extend downward; and a plurality of tool blade members mounted to leading end portions of the support pipes, respectively, each of the tool blade members comprising:

a body;

a flow passage formed inside the body to flow a fluid from an outside into an inside of the body;

a plurality of slits formed on an outer peripheral portion of the body so as to extend, in a circumferential direction thereof, from a leading end to a base end of the tool blade member;

a plurality of protruding portions formed between the adjacent slits so as to be inclined inward the tool body; and a plurality of blades formed at leading ends of the protruding portions, respectively, wherein the boring tool is moved downward in an axial direction thereof toward a mold, the blades act to collapse sand of the mold to an inner side of the tool blade member of the mold boring tool, and the slits allow the sand collapsed by the blades to be discharged to an outside of the mold by an action of the fluid flowing from the support pipes and then the flow passage into the slits.

A further disclosed embodiment provides a mold boring apparatus, comprising:

a molding board on which a mold is placed;

an elevating unit disposed above the molding board to be vertically movable; and a mold boring tool provided for the elevating unit to be vertically movable; and a fluid supply source that supplies a fluid to the mold boring tool, the mold boring tool having a structure mentioned above.

It is further to be noted that the term "boring" used for making a hole to a mold may be substituted with term "punching" for making a hole to a mold.

According to the mold boring method of making a hole in a mold, the mold boring tool, and the mold boring apparatus for a mold, the blades of the mold boring tool act to stick and collapse the sand of the mold to the inner side of the mold boring tool, and the collapsed sand is discharged to the outside of the mold by the fluid flowing from the flow passage of the mold boring tool into the slits. Accordingly, at the time of making the hole in the mold, an excessive compressive force does not act on the sand of the mold, which results in reduction of a load on the mold at the time of making the hole in the mold to thereby prevent the breakage of the mold. Further, the hole can be formed in the mold by applying a small load to the boring tool, thus being advantageous.

The nature and further characteristic features will be made clearer from the following descriptions made with reference to the accompanying drawings.

BRIEF DESCRIPTION OF THE DRAWINGS

In the accompanying drawings:

FIG. 2 illustrates an essential structure of a mold boring tool of the mold boring apparatus shown in FIG. 1, in which

FIG. 3 illustrate specifications in use of the boring tool (blade edge thereof) of FIG. 2, in which

FIG. 5 is a table in which shapes of the mold boring tool (tool blade member) of FIGS. 3A to 3C are shown for the respective specifications;

FIG. 6 includes FIGS. 6A and 6B, in which

FIG. 7 is a table showing comparison of boring times (i.e., periods of time) in a plurality of experimental examples using the mold boring tool of the respective specifications of FIGS. 3A to 3C;

FIG. 8 is a table showing comparison of diameters of formed holes in a plurality of experimental examples using the mold boring tool of the respective specifications of FIGS. 3A to 3C;

FIG. 9 shows variations of the boring periods of time in the plurality of experimental examples using the mold boring tool (i.e., tool blade members thereof) of the respective specifications of FIGS. 3A to 3C, in which

FIG. 10 shows variations of the diameters of the formed holes in the plurality of experimental examples using the mold boring tool of the respective specifications of FIGS. 3A to 3C, in which

FIG. 11 is a table in which average values and standard deviations of the boring periods of time of FIG. 7 and the hole diameters of FIG. 8 are described for the respective specifications of the mold boring tool of FIG. 3;

DESCRIPTION OF THE DISCLOSED EMBODIMENT

Hereinafter, disclosed embodiments are described with reference to the accompanying drawings. It is further to be noted that the present invention is not limited to the following disclosed embodiments.

Figure 1:
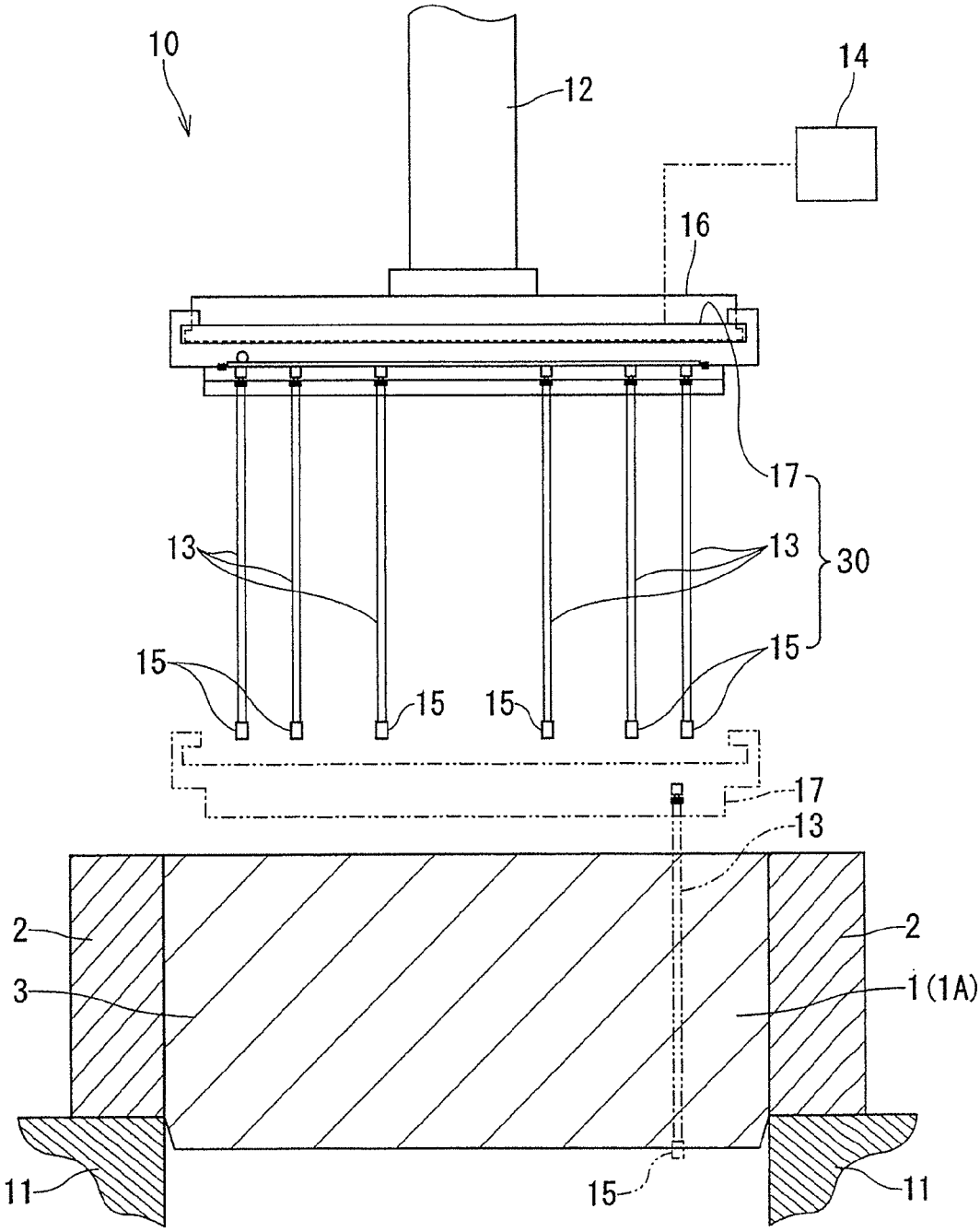
FIG. 1 is a view illustrating an entire configuration of a mold boring apparatus for making a hole in a mold according to one disclosed embodiment.

With reference to FIG. 1 illustrating an entire structure of a mold boring apparatus for making or punching a hole in a mold according to one disclosed embodiment, a mold boring apparatus 10 is an apparatus for boring, i.e., making or punching, holes such as degassing holes 9 (FIG. 13) in a mold 1. The mold boring apparatus (which may be merely called as "boring apparatus 10" hereinafter) includes a molding board 11, a cylinder assembly 12 corresponding to an elevating (lifting/lowering) unit, support pipes 13, an air compressor 14 corresponding to a fluid supply source, and a mold boring tool 30 for boring a mold 1.

Figure 13:
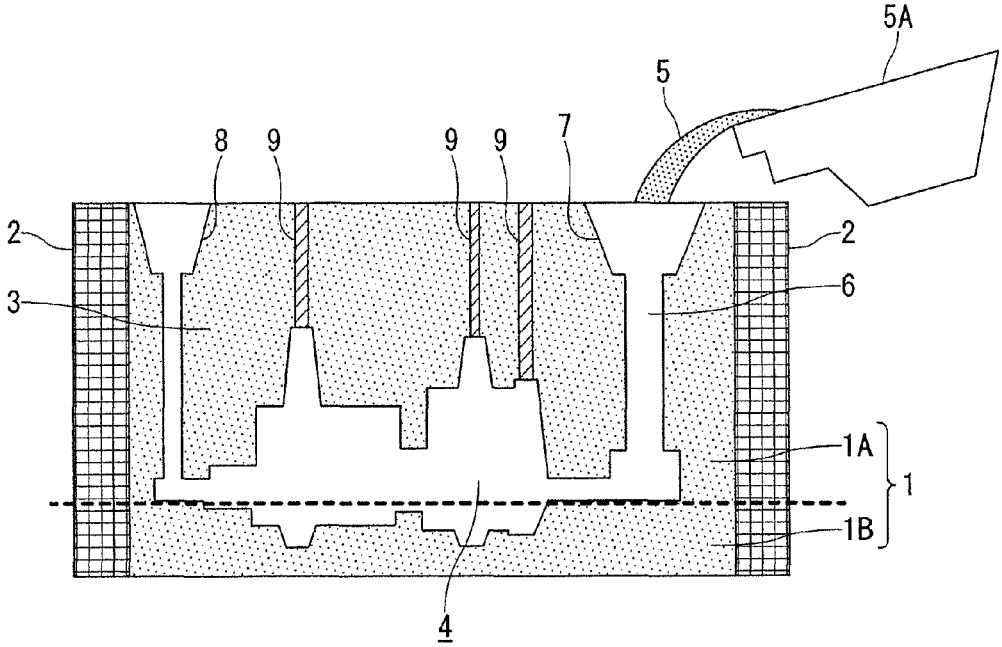
FIG. 13 is a vertical sectional view illustrating a structure of the mold of FIG. 1.

The mold 1 illustrated in FIG. 1 corresponds to an upper mold (upper mold half) 1A or a lower mold (lower mold half) 1B illustrated in FIG. 13 (in the disclosed embodiment, the upper mold 1A is shown), and is formed by filling a mold frame 2 such as a metal frame with sand (molding sand) 3. A cavity 4 and a runner 6 are formed in the mold 1 (the upper mold 1A, the lower mold 1B). The cavity 4 serves to shape a cast product, and the runner 6 serves to guide molten metal 5 into the cavity 4. The upper mold 1A is specifically provided with a sprue 7 and a riser 8, and the sprue 7 is communicated with the runner 6. The molten metal 5 is poured into the sprue 7 from a ladle 5A, and the riser 8 serves to discharge initial molten metal and foreign matters without keeping the same in the cavity 4.

The degassing holes 9 are further formed in the upper mold 1A (FIG. 13), and the degassing holes 9 serve to discharge air accumulated in the cavity 4 and gas generated from a binder for solidifying the mold 1 externally of the mold 1. The degassing holes 9 are formed by inserting tools from the cavity 4 side after formation of the mold 1. The inserting tools are the mold boring tool 30 (which may be merely called "boring tool 30" hereinafter), included in the boring apparatus 10 in the disclosed embodiment.

As illustrated in FIG. 1, the mold 1 is placed on the molding board 11 of the boring apparatus 10 directly or indirectly through the mold frame 2. The cylinder assembly 12 is disposed above the molding board 11, and the cylinder assembly 12 moves up and down a movable plate 16 fixed to the leading end of a piston rod, not shown, to thereby vertically moves a mount plate 17 (i.e., mold boring tool 30) attached to the movable plate 16 with respect to the molding board 11. The support pipes 13 are provided to the mount plate 17 so as to extend vertically downward to the molding board 11.

Figure 2B:
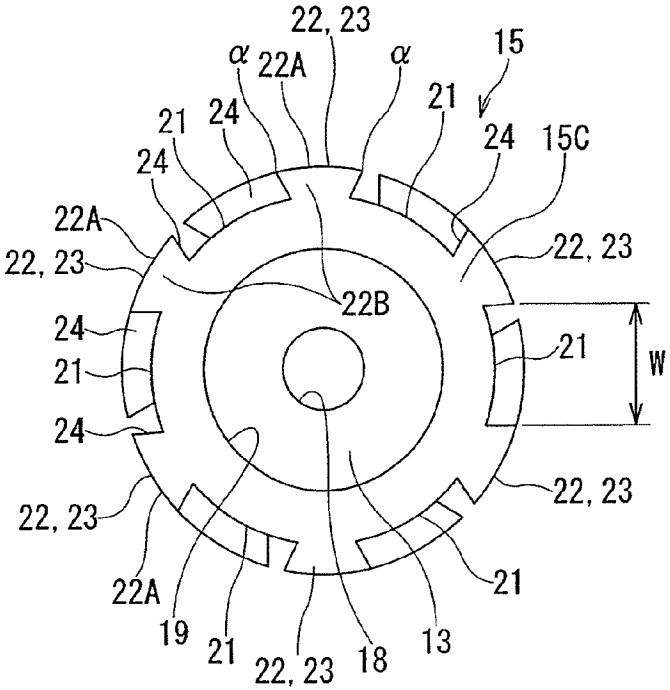
FIG. 2A is a sectional side view and FIG. 2B is a view viewed from an arrow IIB in FIG. 2A.
Figure 2A:
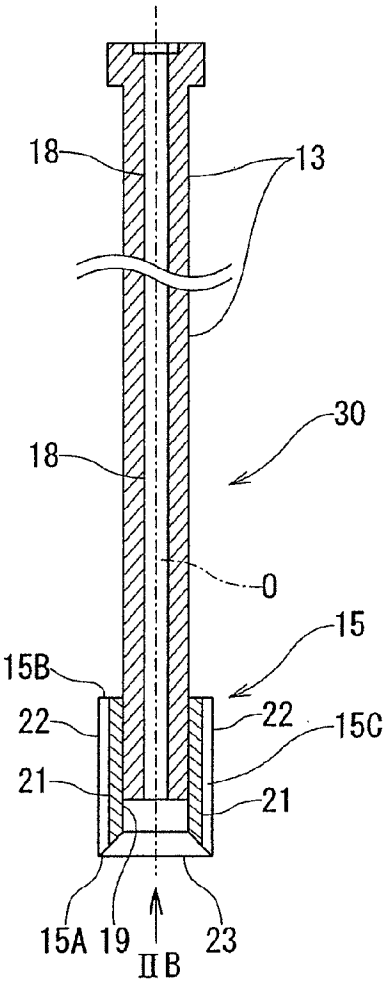

Each support pipe 13 is formed into a hollow structure as illustrated in FIG. 2A, and a passage 18 is formed inside the support pipe 13 as pipe passage 18. Tool blade members 15 of the boring tool 30 are fitted to the leading end of the support pipes 13, respectively.

In the mentioned structure, it may be said that the boring tool 30 of the disclosed embodiment comprises the mount plate 17, support pipes 13 provided for the mount plate 17 so as to extend downward, and the tool blade members 15 fitted with the support pipes 13, respectively, at the downward end portions thereof.

Further, the air compressor 14 is connected to the support pipe 13, and air as a fluid is supplied from the air compressor 14 into the pipe passage 18. The supplied air is guided from the pipe passage 18 to the boring tool 30.

Each tool blade member 15 of the boring tool 30 has an outer body 15C, to which slits 21 and protruded portions 22, mentioned hereinafter, are formed) formed into a hollow structure as illustrated in FIG. 2A to FIG. 4, and a passage 19, through which the air as the fluid flows, is formed to the tool blade member 15 inside the outer body 15C as tool passage 19. An internal thread 20 is formed on an inner surface of the tool passage 19, and the internal thread 20 is engaged with an external thread, now shown, formed at the leading end of the support pipe 13, so that the tool blade member 15 is fitted to the leading end of the support pipe 13 through screw engagement. By fitting the tool blade member 15 to the support pipe 13, the tool passage 19 is communicated with the pipe passage 18 of the support pipe 13.

A plurality of (six, in the disclosed embodiment) slits 21 are formed on an outer peripheral portion of the outer body 15C of the tool blade member 15 in the circumferential direction thereof so as to extend from a leading end 30A to a base end 30B of the tool blade member 15, i.e. boring tool 30, and blades (blade edge) 23 are formed respectively at the leading ends of protruding portions 22 formed to the outer body 15C of the boring tool 30 between the slits 21 also formed to the outer body 15C.

Figure 6A:
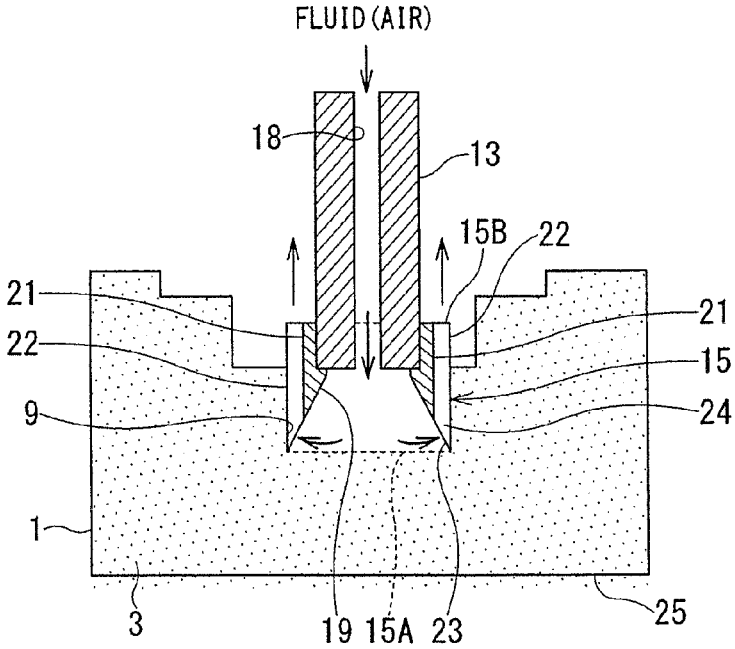
FIG. 6A is a sectional view schematically illustrating an action of the mold boring tool according to one disclosed embodiment.

As illustrated in FIG. 2A and FIG. 6A, the blades 23 are formed in a manner inclined to the inner side of the tool blade member 15 of the boring tool 30. Then, when the boring tool 30 is operated in a direction of an axis O (axial direction O) of the pipe 13 to form the degassing hole 9 in the mold 1, the blades 23 act to collapse the sand 3 of the mold 1 to the inside of the boring tool 30 (i.e., tool blade member 15, toward the axis O of the boring tool 30).

Figure 3A:
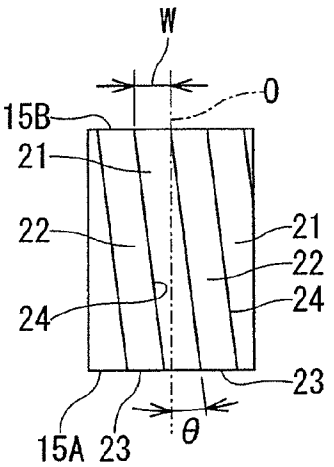
FIGS. 3A and 3B are respective side views of a specification A and a specification B, and FIG. 3C includes a side view and a bottom view of a specification C.
Figure 3B:
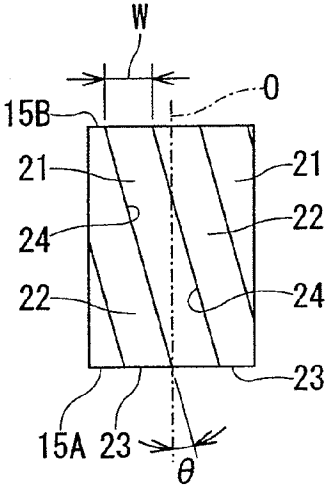
Figure 3C:
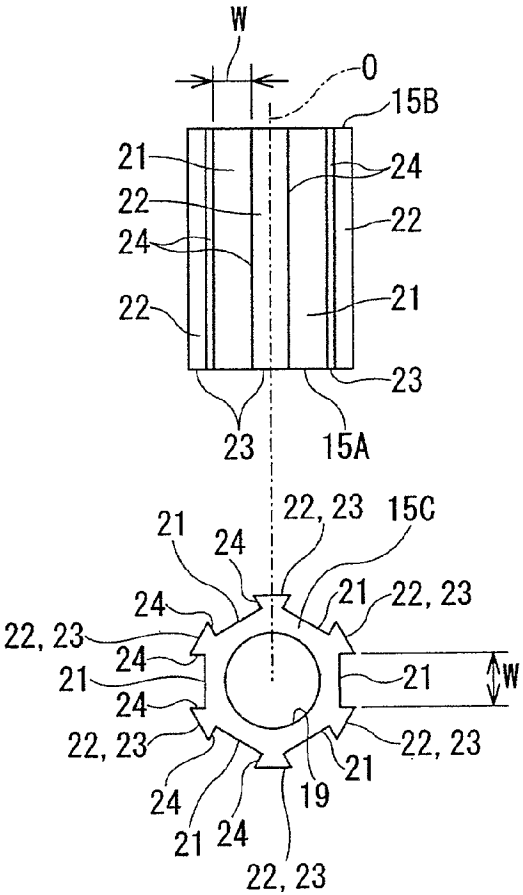
Figure 4:
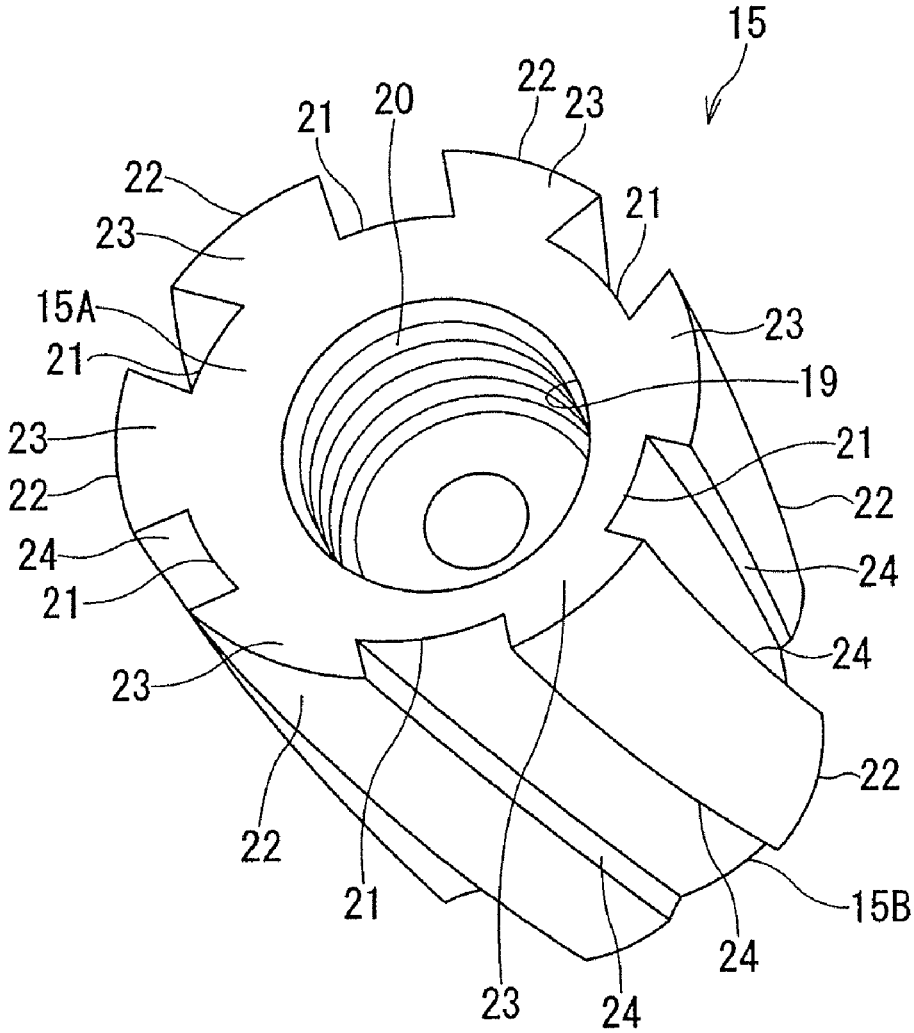
FIG. 4 is a perspective view illustrating the blade edge portion of the mold boring tool of the mold boring apparatus of FIG. 1.

As illustrated in FIG. 2B and FIG. 3C, each slit 21 is defined by opposing side surfaces 24 of the two protruding portions 22, formed on the outer peripheral portion of the outer body 15C of the tool blade member 15, adjacent in the circumferential direction. The air that is guided from the pipe passage 18 of the support pipe 13 to the tool passage 19 of the boring tool 30 flows into the slits 21 as indicated by arrows of FIG. 6A, and the air carries the sand 3 of the mold 1 collapsed by the blades 23 into the slits 21 and then discharges the sand 3 outside of the mold 1 during the time interval when the air flows through the slits 21 from the leading end 30A to the base end 30B of the tool blade member 15 of the boring tool 30.

As illustrated in FIGS. 3A and 3B, the protruding portions 22 are formed on the outer peripheral surface of the outer body 15C of the boring tool 30 in a fashion inclined by a predetermined twist angle θ with respect to the axial direction O of the boring tool 30. In the boring tool 30 of a specification A illustrated in FIG. 3A, the twist angle θ is set to 5.5°. In the boring tool 30 of a specification B illustrated in FIG. 3B, the twist angle θ is set to 13.4°. When the boring tool 30 is moved in the axial direction O to form the degassing hole 9 in the mold 1, the side surfaces 24 of the inclined protruding portions 22 function as blades (blade edges) gradually collapsing the sand 3 existing in the slits 21. Further, in the boring tool 30 of a specification C illustrated in FIG. 3C, the protruding portions 22 are formed so as to be parallel (θ=0°) to the axial direction O of the boring tool 30.

In the case where the protruding portions 22 are formed to be inclined to the axial direction O, each of the slits 21 is defined between the two adjacent protruding portions 22 on the outer circumference of the tool blade member 15 of the boring tool 30 in a fashion similarly inclined to the axial direction O thereof at the same twist angle θ as that of the protruding portions 22.

In the case where the protruding portions 22 are formed to be parallel to the axial direction O, each of the slits 21 is defined to be similarly parallel to the axial direction O of the boring tool 30.

In the case where the slits 21 are inclined by the twist angle θ with respect to the axial direction O of the boring tool 30, the air that has flowed from the tool passage 19 of the boring tool 30 into the slits 21 swirls through the slits 21 from the leading end 30A to the base end 30B of the tool blade member 15 of the boring tool 30.

As illustrated in FIG. 2B and FIG. 3C, each side surface 24 of the protruding portion 22 is formed in a fashion inclined from a side edge a of a leading end surface 22A of the protruding portion 22 to a base portion 22B of the protruding portion 22 such that the base portion 22B has a width smaller than that of the leading end surface 22A. This structure prevents collapse of a portion of the sand 3 existing in the outer side of the slits 21 (in the outer side in the radial direction of the horizontal section of the boring tool 30), even in a case where the side surface 24 functions as a blade (the specification A of FIG. 3A, the specification B of FIG. 3B) or not function as the blade (the specification C of FIG. 3C).

Then, the graph of FIG. 5 represents shapes of the respective tool blade members 15 of the boring tool 30 of the specification A, the specification B, and the specification C. In FIG. 5, the "outer diameter" represents a distance between the leading end surfaces 22A of the opposing protruding portions 22 in the tool blade member 15 of the boring tool 30, and the "shaft length" represents a length of the tool blade member 15 in the axial direction O. The "twist angle" represents the twist angle θ of the protruding portions 22 and the slits 21 with respect to the axial direction of the tool blade member 15 of the boring tool 30, and the "number of cutouts" represents the number of the slits 21. The "cutout width" represents a width W (FIG. 2B, FIG. 3C) of the slits 21, and the "air blowing area" represents a flow passage area of the tool passage 19 of the tool blade member 15. The "sand discharging area" represents the sum of areas of the slits 21. The tool blade member 15 of the boring tool 30 is made of, for example, tool steel SKD61.

In the followings, an operation of the mold boring apparatus 10 will be described.

The mold boring apparatus 10 illustrated in FIG. 1 includes the mold boring tool 30 provided with the tool blade members 15 respectively fitted to the leading ends of the support pipes 13, and the mold frame 2 is brought into contact with the molding board 11 in a manner such that the mold 1 (upper mold 1A) is placed on the molding board 11 with a cavity 4 facing upward.

Next, the cylinder assembly 12 is operated to move down the mount plate 17, the boring tool 30 including the support pipes 13 is moved downward in the axial direction thereof, and the tool blade members 15 of the boring tool 30 are stuck into the sand 3 of the mold 1. The air compressor 14 is operated at a time when the support pipes 13 of the boring tool 30 are moved downward, and as illustrated in FIG. 6A, air is supplied to the tool passage 19 of each tool blade member 15 via the pipe passage 18 of each support pipe 13.

According to the structure of the mold boring apparatus 10 mentioned above, the blades (blade edges) 23 of the respective tool blade members 15 stick and collapse the sand 3 of the mold 1 to the inner side of the tool blade member 15, and the sand 3 collapsed by the blades 23 is discharged to the outside of the mold 1 through the slits 21 by an action of the air flowing from the tool passage 19 into the slits 21.

With regard to the mold boring tool 30 of the specification A (FIG. 3A) and the specification B (FIG. 3B), when the boring tool 30 is moved down, the side surfaces 24 of the protruding portions 22 function as blades to thereby gradually collapse the sand 3 in the slits 21. This gradually collapsed sand is discharged by an action of the air to the outside of the mold 1 through the slits 21 together with the sand 3 collapsed by the blades 23. In this way, the degassing holes 9 are formed in the mold 1.

Then, in the followings, characteristics (boring periods of time, diameters of formed holes) of the respective boring tools 30 (tool blade members 15) of the specification A, the specification B, and the specification C are compared with one another with reference to FIG. 7 to FIG. 12.

Thirty-two experimental examples for comparing the boring periods of time and thirty-two experimental examples for comparing the hole diameters were carried out, and the boring tools 30 (including tool blade members 15) of the specifications shown in FIG. 5 were used in the respective experimental examples. At this time, the pressure of air supplied from the air compressor 14 to the boring tool 30 was 0.3 MPa, the force of the cylinder assembly 12 for moving the boring tool 30 in the axial direction O (axis O) was 27.4 kN, and the thickness of the mold 1 was 280 mm.

As shown in FIG. 7, the average boring period of time in the thirty-two experimental examples for comparing the boring periods of time is 4.2 seconds in the boring tool 30 of the specification A, and this value is smaller than those of the boring tool 30 of the other specifications. In addition, the standard deviation of the boring periods of time is 0.9 in the boring tool 30 of the specification A, and this value is smaller than that of the boring tool 30 of the other specifications. Variations of the boring periods of time represented by the standard deviation will be determined with reference to graphs shown in FIGS. 9A to 9C.

Figure 9A:
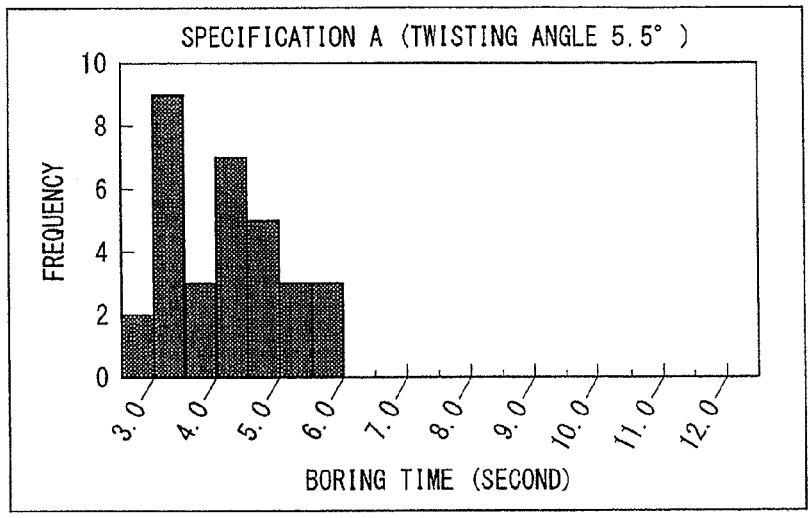
FIG. 9A is a graph showing the case of the specification A.
Figure 9B:
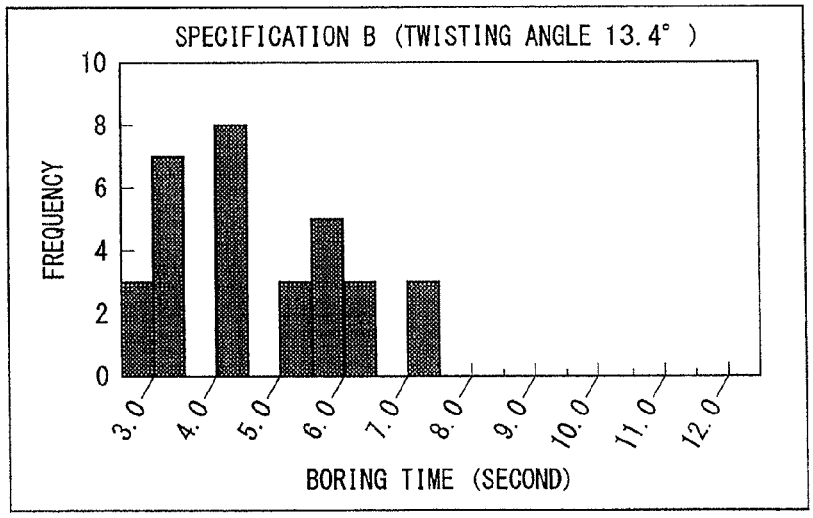
FIG. 9B is a graph showing the case of the specification B.
Figure 9C:
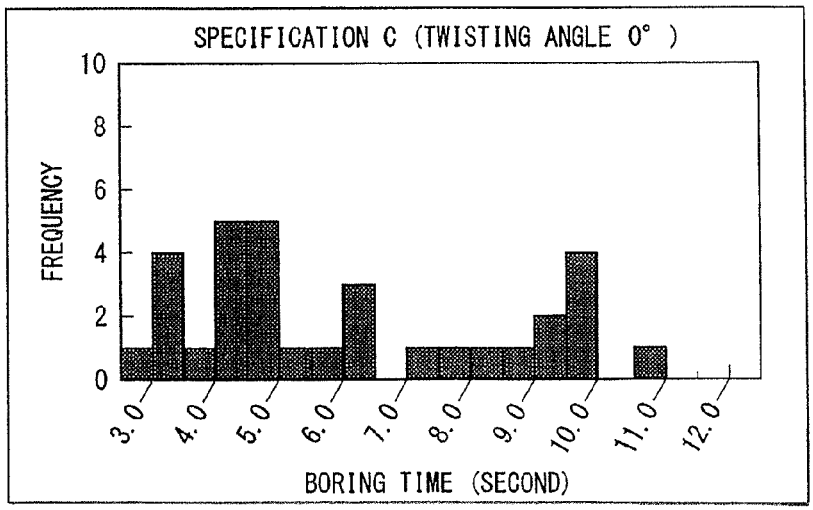
FIG. 9C is a graph showing the case of the specification C.

That is, in FIGS. 9A to 9C, data on the boring periods of time shown in FIG. 7 is graphed for each specification on the basis of the classification of: the number of experimental examples in a range equal to or less than 3.0 seconds (for example, two in the case of the specification A); the number of experimental examples in a range more than 3.0 seconds and equal to or less than 3.5 seconds (for example, nine in the case of the specification A); the number of experimental examples in a range more than 3.5 seconds and equal to or less than 4.0 seconds (for example, three in the case of the specification A); the number of experimental examples in a range more than 4.0 seconds and equal to or less than 4.5 seconds (for example, seven in the case of the specification A); and the numbers of experimental examples in ranges that are similarly set for each 0.5 seconds.

As mentioned above, FIGS. 9A to 9C reveal that the boring tool 30 of the specification A, which has the smallest variations of the boring periods of time, is the most excellent.

As shown in FIG. 8, the average hole diameter in the thirty-two experimental examples for comparing the hole diameters was about 10.5 mm in the tool blade member 15 of the boring tool 30 of the specification A, and this value was smaller than those of the specifications B and C. In addition, the standard deviation of the hole diameters was about 0.12 of the specification A, and this value was smaller than those of the other specifications. Variations of the hole diameters represented by the standard deviation will be determined with reference to graphs shown in FIGS. 10A to 10C.

Figure 10A:
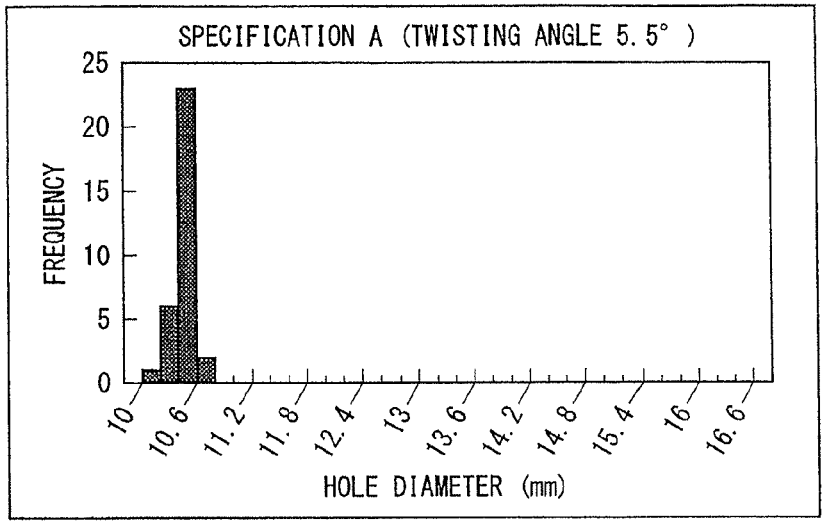
FIG. 10A is a graph showing the case of the specification A.
Figure 10B:
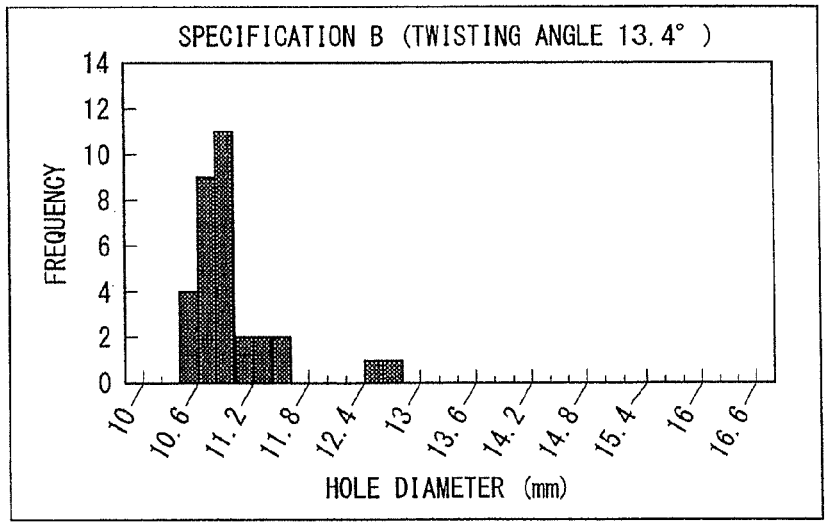
FIG. 10B is a graph showing the case of the specification B.
Figure 10C:
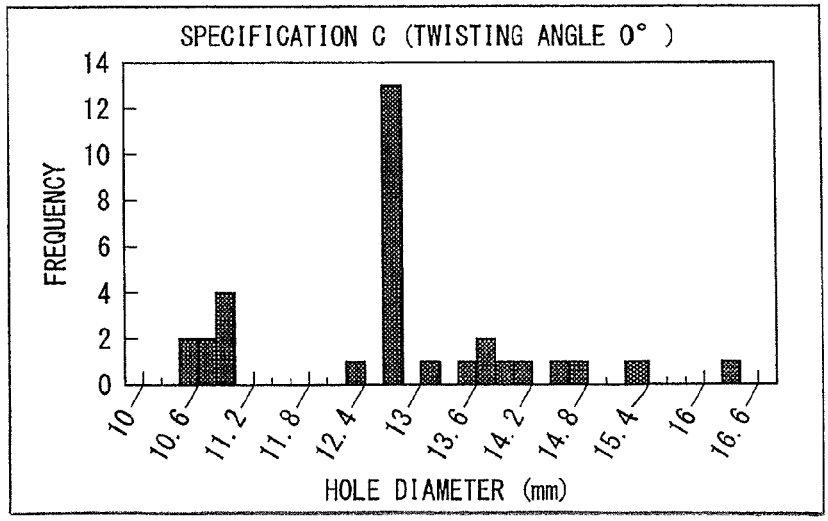
FIG. 10C is a graph showing the case of the specification C.

That is, in FIGS. 10A to 10C, data on the hole diameters shown in FIG. 8 is graphed for each specification on the basis of the classification of: the number of experimental examples in a range more than 10 mm and equal to or less than 10.2 mm (for example, one in the case of the specification A); the number of experimental examples in a range more than 10.2 mm and equal to or less than 10.4 mm (for example, six in the case of the specification A); the number of experimental examples in a range more than 10.4 mm and equal to or less than 10.6 mm (for example, twenty-three in the case of the specification A); and the numbers of experimental examples in ranges that are similarly set for each 0.2 mm.

FIGS. 10A to 10C reveal that the tool blade member 15 of the boring tool 30 the specification A, which has the smallest variations of the diameters of the formed holes, is the most excellent.

FIG. 11 is a table in which the average values and the standard deviations of the boring periods of time shown in FIG. 7, and the average values and the standard deviations of the hole diameters shown in FIG. 8 are summarized for each specification of the boring tool 30.

Figure 12:
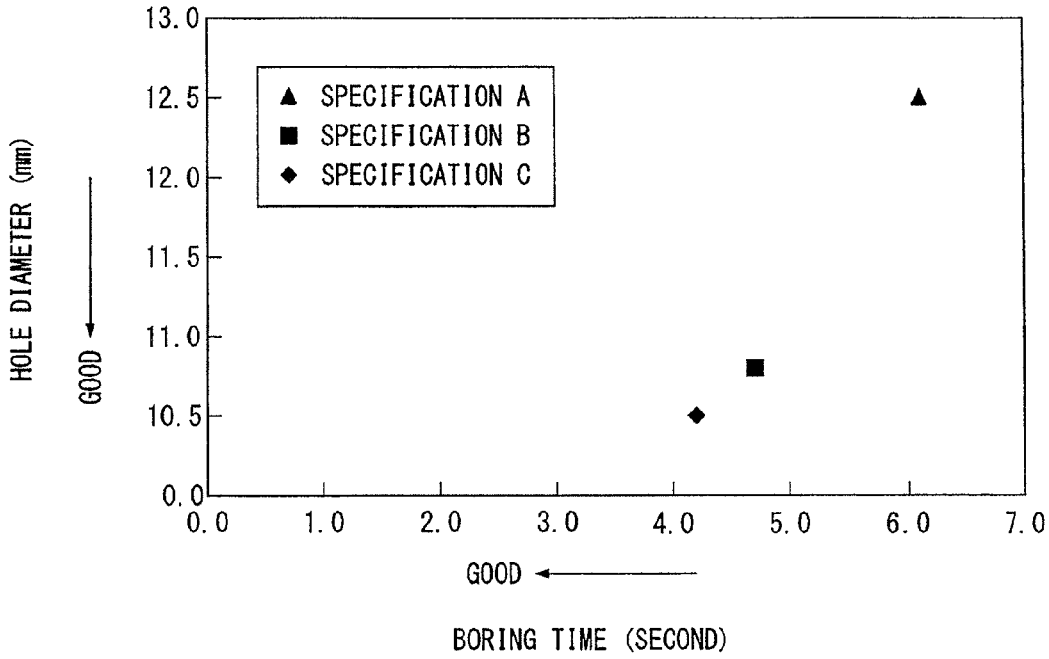
FIG. 12 is a graph showing results of FIG. 11, in which the horizontal axis represents the boring period of time and the vertical axis represents the hole diameter.

FIG. 12 is a graph showing the boring periods of time and the hole diameters of FIG. 11 that are plotted for each specification, in which the horizontal axis represents the boring period of time and the vertical axis represents the hole diameter. FIG. 12 also reveals that the tool blade member 15 of the boring tool 30 of the specification A has the optimal shape in terms of the boring period of time and the hole diameter.

The disclosed embodiment having the structure or configuration described above provides the following advantageous functions and effects (1) to (4).

(1) As illustrated in FIG. 6A, the blades 23 of the tool blade members 15 mold boring tool 30 of the mold boring apparatus 10 collapse the sand 3 of the mold 1 inside the tool blade members 15 of the boring tool 30, and the collapsed sand 3 is discharged outside the mold 1 by the air flowing in the slits 21 from the tool passage 19 of the tool blade member 15. Accordingly, when the degassing hole 9 is formed in the mold 1, an excessive compressive force does not act on the sand 3 of the mold 1, thus reducing the load which may be applied on the mold 1 at the boring operation to the mold 1 to thereby prevent the breakage of the mold, particularly, the breakage at a penetration boundary side 25 of the mold 1.

Furthermore, since an excessive compressive force does not act on the mold 1 at the time of making a hole in the mold 1, the degassing hole 9 can be formed in the mold 1 with the application of a small load to the boring tool 30, and the breakage of the tool blade member 15 and the support pipe 13 of the mold boring tool 30 can be prevented. As a result, the plurality of degassing holes 9 each having a small diameter can be formed in the mold 1.

Figure 6B:
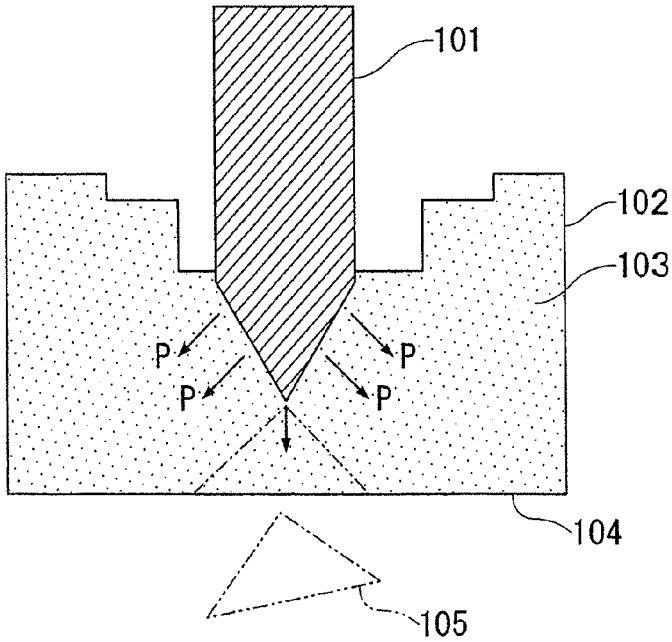
FIG. 6B PRIOR ART
FIG. 6B is also a sectional view schematically illustrating an action of a conventional mold boring tool.

With regard to the breakage of the mold 1, for example, in the case of the hole diameter formed by the boring pin 101 as illustrated in FIG. 6B as a conventional example, a collapsed sand portion (breakage sand 105) having a diameter of about 100 mm and a depth of about 30 mm is formed near the hole at the penetration boundary side 104 of the boring pin 101. In contrast, however, in the case of using, particularly, the boring tool 30 of the specification A according to one disclosed embodiment, merely a collapsed sand portion having a diameter of about 30 mm and a depth of about 10 mm is formed near the hole at the penetration boundary 25 of the mold 1.

(2) As illustrated in FIGS. 3A to 3C, the boring tool 30 is provided with the protruding portions 22 and the slits 21 in a manner inclined by the predetermined twist angle θ (θ=5.5°, θ=13.4°) with respect to the axial direction (axis O) of the boring tool 30. Accordingly, when the boring tool 30, i.e., tool blade members 15, is moved in the axial direction, the side surfaces 24 of the protruding portions 22 can gradually collapse the sand 3 of the mold 1 existing in the slits 21, and air passes as a swirling flow through the slits 21, thus enhancing the discharging performance of the sand 3. As a result, it appears that the use of, particularly, the boring tool 30 of the specification A and the specification B can make a hole in the mold 1 with high precision.

Particularly in the case where the twist angle θ of the protruding portions 22 and the slits 21 formed to the outer body 15C of the tool blade member 15 of the boring tool 30 is 5.5°, the sand discharging performance of the air flowing through the slits 21 is further enhanced, and hence, a hole can be made (bored) in the mold 1 with further high precision.

(3) As illustrated in FIG. 2B and FIG. 3C, each side surface 24 of the protruding portion 22 of the boring tool 30 is formed in a manner inclined from the side edge α of the leading end surface 22A of the protruding portion 22 to the base portion 22B of the protruding portion 22. Accordingly, a portion of the sand 3 existing on the outer side of the slits 21 can be prevented from collapsing, so that the diameter of the formed hole (degassing hole 9) can be prevented from becoming larger, and in addition, in this point of view, the boring precision for the mold 1 can be enhanced.

(4) The boring tool 30 is moved in the axial direction by the cylinder assembly 12 (FIG. 1) without being rotated, and accordingly, a mechanism that rotates the boring tool 30 is not necessary, so that an entire equipment of the mold boring apparatus 10 can be made compact.

It is finally to be noted that although the present invention has been described hereinabove by way of the disclosed embodiments, the present invention is not limited thereto, and many other alternations and modifications may be made without departing the scopes of the appended claims.

For example, in one disclosed embodiment, although the air is only mentioned as the fluid that flows inside the slits of the boring tool, many other fluids such as gasses other than air or water may be applied.

The invention claimed is:

1. A method of boring a hole in a mold, comprising:

preparing a mold boring apparatus including a mold boring tool having a flow passage that is formed inside of the mold boring tool and allows a fluid to flow therethrough, a plurality of slits and a plurality of protruding portions that are formed on an outer peripheral portion of an outer body of a tool blade member of the mold boring tool in a circumferential direction thereof so as to extend from a leading end to a base end of the tool blade member, and a plurality of blades that are inclined inward and are respectively formed at leading ends of the protruding portions formed between the adjacent slits;

fitting the tool blade member to a leading end of a support pipe provided for a mount plate of the mold boring apparatus so as to support the tool blade member;

introducing the fluid from the support pipe into the flow passage of the tool blade member of the mold boring tool when the mold boring tool is moved in an axial direction thereof to be stuck into sand of the mold; and boring the hole in the mold while the blades of the mold boring tool act to collapse the sand of the mold to an inner side of the tool blade member of the boring tool, and the sand collapsed by the blades is discharged to an outside of the mold through the slits by an action of the fluid flowing from the flow passage into the slits.

2. The method of boring a hole in a mold according to claim 1, wherein the hole of the mold is a degassing hole.

* * * * *